US009551091B2

(12) United States Patent
Wagner

(10) Patent No.: US 9,551,091 B2
(45) Date of Patent: Jan. 24, 2017

(54) PROCESS AND EQUIPMENT FOR THE PRODUCTION OF MICRO-CARBONFIBERS

(71) Applicant: Sharon Wagner, Westlake Village, CA (US)

(72) Inventor: Anthony S. Wagner, Santa Fe, NM (US)

(73) Assignee: Hexa Nano Carbon LLC, West Hollywood, CA (US)

( * ) Notice: Subject to any disclaimer, the term of this patent is extended or adjusted under 35 U.S.C. 154(b) by 0 days.

(21) Appl. No.: 14/583,550

(22) Filed: Dec. 26, 2014

(65) Prior Publication Data

US 2015/0184316 A1 Jul. 2, 2015

Related U.S. Application Data

(60) Provisional application No. 61/921,076, filed on Dec. 26, 2013, provisional application No. 61/920,992, filed on Dec. 26, 2013.

(51) Int. Cl.
*D01F 9/133* (2006.01)
*D01F 9/127* (2006.01)

(52) U.S. Cl.
CPC ..... *D01F 9/133* (2013.01); *D01F 9/127* (2013.01)

(58) Field of Classification Search
CPC ..... D01F 9/127; D01F 9/133
See application file for complete search history.

(56) References Cited

U.S. PATENT DOCUMENTS 2,959,528 A * 11/1960 De Varda ..... C25C 3/06 204/244
4,540,457 A * 9/1985 LaValley ..... F16K 1/228 156/182
4,994,303 A * 2/1991 Calkins ..... D06M 11/38 427/173
5,203,681 A * 4/1993 Cooper ..... F04D 7/065 417/360
5,501,582 A * 3/1996 Gautier ..... F04D 13/027 415/110
5,676,520 A * 10/1997 Thut ..... F04D 7/065 266/235
5,791,888 A * 8/1998 Smith ..... F01C 21/104 418/149
5,961,285 A * 10/1999 Meneice ..... F04D 7/065 415/126

(Continued)

OTHER PUBLICATIONS

Definition of "proprietary," accessed online at http://www.merriam-webster.com/dictionary/proprietary on Sep. 29, 2015.*

(Continued)

*Primary Examiner* — Daniel C McCracken
(74) *Attorney, Agent, or Firm* — SoCal IP Law Group LLP; Jonathan Pearce; Steve C. Sereboff

(57) ABSTRACT

There is disclosed a method and an apparatus for production of micro-carbon fibers. The method comprises introducing a selected chemical mixture suitable for creating micro-carbon fibers into a heating chamber and heating the heating chamber using a series of burners. The method further comprises injecting carbon feed stock into a catalyst reaction chamber to initiate a micro-carbon generating chemical process to occur.

8 Claims, 2 Drawing Sheets

(56) References Cited

U.S. PATENT DOCUMENTS

| | | | | |
|---|---|---|---|---|
| 6,227,126 | B1 * | 5/2001 | Wagner | F23G 5/008 110/203 |
| 6,451,247 | B1 * | 9/2002 | Mordue | B22D 39/00 266/239 |
| 6,457,940 | B1 * | 10/2002 | Lehman | F04D 7/06 29/889.4 |
| 7,841,379 | B1 * | 11/2010 | Evans | B22D 17/06 164/133 |
| 2003/0075844 | A1 * | 4/2003 | Mordue | B22D 39/00 266/239 |
| 2006/0008405 | A1 * | 1/2006 | Wagner | B01J 4/002 423/445 R |
| 2008/0056980 | A1 * | 3/2008 | Wagner | B82Y 30/00 423/461 |
| 2008/0190970 | A1 * | 8/2008 | Sanders | B22D 39/00 222/593 |
| 2010/0084440 | A1 * | 4/2010 | Mordue | C21C 1/06 222/591 |
| 2014/0363309 | A1 * | 12/2014 | Henderson | F04D 7/065 417/53 |
| 2015/0184316 | A1 * | 7/2015 | Wagner | D01F 9/127 423/447.3 |

OTHER PUBLICATIONS

Declaration of Vesselin N. Shanov, Ph.D. dated Jul. 12, 2008, filed in U.S. Appl. No. 10/887,695 (7 pages).*
Declaration of Robert S. Dinwiddie, Ph.D. dated May 6, 2008, filed in U.S. Appl. No. 10/887,695 (15 pages).*
Declaration of Anthony S. Wagner dated Jul. 11, 2008, filed in U.S. Appl. No. 10/887,695 (5 pages).*

* cited by examiner

PROCESS AND EQUIPMENT FOR THE PRODUCTION OF MICRO-CARBONFIBERS

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims priority from the following provisional patent application 61/921,076 filed Dec. 26, 2013 titled PROCESS AND EQUIPMENT FOR THE PRODUCTION OF MICRO-CARBONFIBERS and 61/920,992 filed Dec. 26, 2013 titled A NOVEL METHOD FOR GENERATION OF LARGE VOLUMES OF HYDROGEN MOLECULES, BY THE MOLECULAR DECOMPOSITION AND THE SEPARATION OF HYDROGEN ATOMS FROM HYDROCARBONS.

BACKGROUND

Field

This unique standard chemical method is for the atomic molecular separation of hydrogen molecules from hydrocarbons compounds, which in turn, produces large volumes of molecular concentrations of hydrogen molecules. It solves the need for huge volumes of non-polluting hydrogen fuels. The hydrogen generated is a bi-product from an accepted chemical decomposition process. Hydrogen is chemically separated in a catalytic chemical process and then isolated and captured from the carbon atoms. It differs from hydrolysis because it is a different process, using non electricity by using a completely different chemical process.

Whereas the production and control of the morphology of carbon fibers has been problematical. This process claims to solve the problems inherent in the production of micro-carbon fibers. Micro-carbon fibers are not nanomaterials because the link is on the order of 100 nm.

SUMMARY OF THE INVENTION

The present patent discloses a novel process and machinery design involving a unique catalyst system within a uniquely designed and engineered production process. Of special interest is the ability to remove the catalyst reaction chamber in order to minimize any blocking on the amorphous carbon generated. The process produces industrial volumes of high quality and homogenous material with low (acceptable) levels of impurities and high thermal stability.

Micro-carbon fibers are not nano materials, because their length is over 100 nm long. The present description embodies the production and control of the morphology, which has been problematical, to produce the unique micro-carbon fibers.

This invention solves the problem of the production of micro-carbon fibers on an industrial scale. The invention discloses cost-effective industrial processes and specialized machines used to produce large volumes of high quality and unique nano-scale carbon fiber material.

The material created is C6 carbon fiber material—the same building blocks as C6H12 Hexene nano-tubes but without hydrogen. The micro-carbon fiber material produced is incredibly good at conducting electricity, absorbing heat, and absorbing microwaves.

This invention discloses a novel new machine design, and a special unique alloy catalyst chemical system. This involves a first, separate chamber, consisting of an enclosed tunnel with an injector on one end, and a second, separate collection chamber at the other end. The catalyst metals are pumped into this "reaction chamber" from a heating chamber by a high temperature graphite pump.

The novel features include the especially designed and engineered production unit and chemical process. The machine captures a carbon feedstock within the catalyst chemical solution, held at a slow-burn temperature of 850° C. The catalyst chemically breaks down the carbon feedstock into monomers, the monomers then polymerize into the micro-carbon fibers controlling the chemical reaction. One additional unique and very important aspect of the chemical equipment is to be able to maintain and also recover the required temperature, specifically, at 800° C.-850° C.

The uses of this invention include the controlled production of the micro-carbon fibers.

Of special interest is the ability to remove and separate the catalyst reaction chamber as it becomes stopped-up with amorphous carbon.

The most important part of this invention, besides the new equipment and machinery, is the special chemical mixture of catalyst metals, Zn, Ti, Na, K, NI, Si, Mo, Mg, Al, Ca, Co, Cr, Cu, Fe, and Ce, of which 11 are known catalysts. Such special chemical mixture and proportions therein are inherent in the new process design. This special 800° C.-850° C. alloy catalyst system has proven to chemically produce micro-carbon fibers.

The invention of the special catalyst metals and chemical mixture (solution), and equipment includes ceramic linings, burners, pumps, and computer control system.

The chosen carbon feedstock is injected into the chemical catalyst system, then the collection of the polymerized micro-carbon fibers, happens in an airtight collection system.

DETAILED DESCRIPTION

Hydro carbon molecules are injected into the disclosed catalyst medium, separating carbon from hydrogen in chemical molar concentration.

The most important part of the process and design of equipment invented; is the special chemical solution of catalyst metals, these metals include Zn, Ti, Na, K, Si, Mo, Mg, Al, Ca, Co, Cr, Cu, Fe and Ce, this special 850 C alloy catalyst system has been proven to produce the desired micro-carbon fibers. The invention of the special catalyst metal chemical mixture system and equipment includes ceramic linings, heating burners, pumps, and computer control system. The chosen carbon feedstock is injected into the chemical catalyst system, then the collection of the polymerized Micro-carbon fibers are collected in an airtight collection system.

Figure 1:
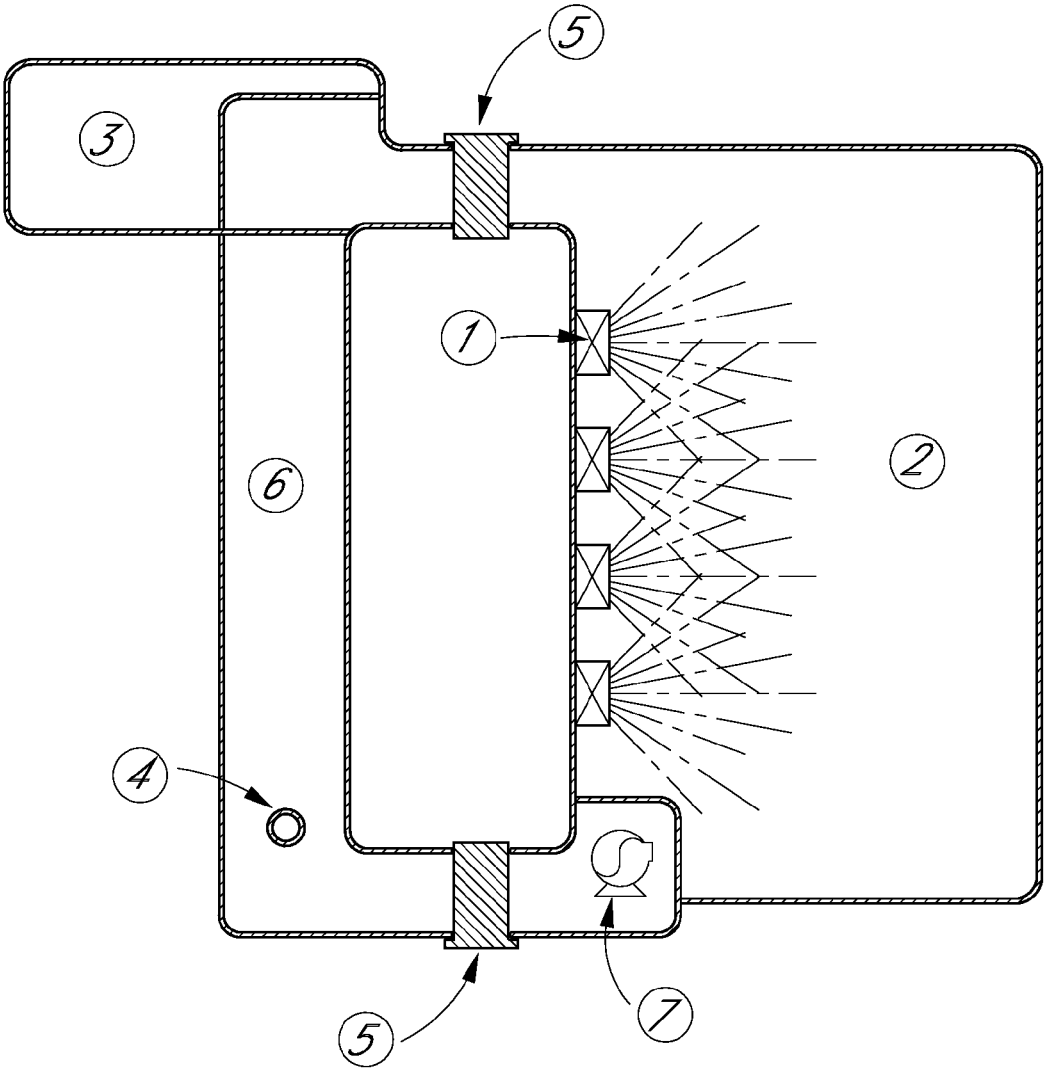
FIG. 1 is a depiction of an apparatus for micro-carbon fiber manufacture.
Figure 2A:
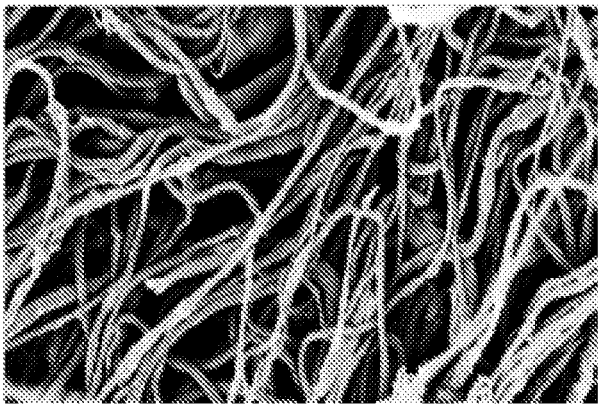
FIGS. 2A, 2B, and 2C, each show examples of the micro-carbon fiber materials as viewed under an electron microscope that are produced as a result of a micro-carbon fiber manufacture process.
Figure 2B:
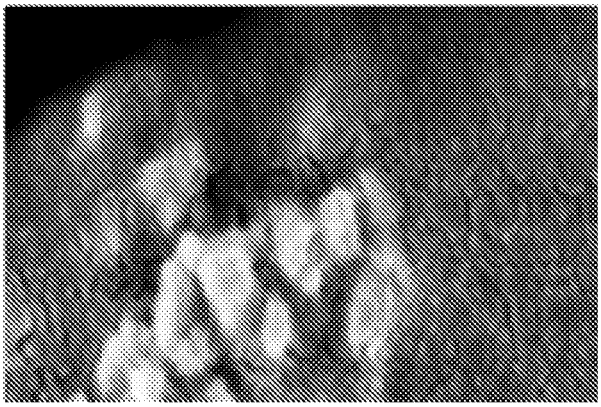
Figure 2C:
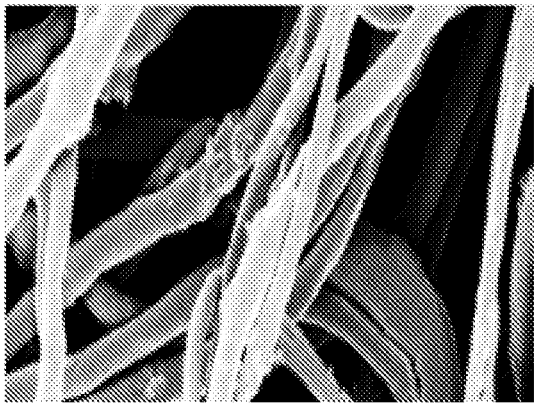

FIG. 1 shows an exemplary system with a number of burners 1 disposed in a heating chamber 2, a CNF collection chamber 3, an injector (feedstock) 4, a pair of removal necks 5, a catalyst reaction chamber 6, and a graphite pump 7.

Cell phone radiation may be absorbed using micro-carbon fiber material, embedded in the plastic or other material and absorbing the electromagnetic radiation. In this way, cell phone radiation protection is provided by these micro-carbon fibers. Absorption of cell phone electromagnetic radiation has been tested and achieved to prove the electromagnetic energy absorbing ability of the micro-carbon fibers.

Example uses for the micro-carbon fibers and resulting hydrogen generated are set forth in table 1 below.

| Characteristics | Uses and applications |
|---|---|
| Micro Carbon Fiber | |
| Fire and heat resistant fibers | Ballistic rated body armors |
| Enhancing lubricating quality | Component in lubrication |
| Antistatic qualities | Space habitat materials |
| Higher strength to weight ratio | Composite material for Aircrafts |
| Higher absorption capacity | Stealth planes and ships |
| Absorption and conductivity | Cell phone antennae |
| Hydrogen | |
| Additive | Fuel additive |
| Combustibility | Direct fuel in vehicles |
| Combustibility | Energy Generation |
| Temperature characteristics | Coolant to Freeze Natural gas |
| Chemical properties | Chemical and pharmaceutical |

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of" respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A method for production of micro-carbon fibers comprising:

introducing a selected chemical mixture suitable for creating micro-carbon fibers into a heating chamber;

heating the heating chamber with a series of burners;

moving heated chemical mixture into a catalyst reaction chamber with a graphite pump;

injecting carbon feed stock into the catalyst reaction chamber to initiate a micro-carbon generating chemical process; and removing the catalyst reaction chamber as it becomes clogged with amorphous carbon using at least one removal neck.

2. The method of claim 1 further comprising collecting created micro-carbon fibers in a micro-carbon fiber collection chamber.

3. The method of claim 1 wherein the temperature in the catalyst reaction chamber is maintained between 800° C. and 850° C. during micro-carbon fiber generation.

4. The method of claim 1 including generation of hydrogen as a byproduct of the process.

5. An apparatus for production of micro-carbon fibers comprising:

a heating chamber for heating a selected chemical mixture suitable for creating micro-carbon fibers;

a series of burners for heating the heating chamber;

a catalyst reaction chamber for enabling a micro-carbon fiber chemical processes to occur;

a graphite pump for moving the heated selected chemical mixture into the catalyst reaction chamber;

an injector for injecting carbon feed stock into the catalyst reaction chamber to initiate the micro-carbon fiber chemical process; and at least one removal neck that enables removal of the catalyst reaction chamber as it becomes clogged with amorphous carbon.

6. The apparatus of claim 5 further comprising a micro-carbon fiber collection chamber for collecting created micro-carbon fibers.

7. The apparatus of claim 5 wherein the temperature in the catalyst reaction chamber is maintained between 800° C. and 850° C. during micro-carbon fiber generation.

8. The apparatus of claim 5 including generation of hydrogen as a byproduct of the process.

* * * * *